US005269047A

United States Patent [19]

Lu

[11] Patent Number: 5,269,047

[45] Date of Patent: * Dec. 14, 1993

[54] HINGE DEVICE FOR CASINGS

[76] Inventor: Sheng N. Lu, No. 174, Chun Ying St., Shu Lin Chen, Taipei Hsien, Taiwan

[ * ] Notice: The portion of the term of this patent subsequent to May 11, 2010 has been disclaimed.

[21] Appl. No.: 896,396

[22] Filed: Jun. 10, 1992

[51] Int. Cl.[5] ..... E05C 17/64

[52] U.S. Cl. ..... 16/340; 16/341

[58] Field of Search ..... 16/340, 341, 342, 337; 361/380

[56] References Cited

U.S. PATENT DOCUMENTS

| | | | |
|---|---|---|---|
| 1,956,040 | 4/1934 | Meyer | 16/340 |
| 2,736,027 | 2/1956 | Parmelee | 16/340 |
| 4,829,633 | 5/1989 | Kassner | 16/340 |
| 5,031,270 | 7/1991 | Lee | 16/341 |

*Primary Examiner*—Paula A. Bradley

*Assistant Examiner*—Chuck Y. Mah

*Attorney, Agent, or Firm*—Oblon, Spivak, McClelland, Maier & Neustadt

[57] ABSTRACT

A hinge device for a casing of the type having a body portion and an upper cover the device including a substantially L-shaped mounting plate adapted to be securely mounted to the body portion of the casing, two washers respectively attached to both sides of the mounting plate, a pivotal axle having a mounting portion adapted to be securely mounted to the upper cover of the casing, an extension pivotally received in a hole of the mounting plate, a spring member, and a nut mounted on a threaded end portion of the extension. The nut biases the spring and allows the pivotal axle to be freely pivotable relative to the spring. When a desired position of the upper cover relative to the body portion of the casing is reached, the spring member biased by the nut exerts a longitudinal force on the pivotal axle to retain the pivotal axle in position.

6 Claims, 1 Drawing Sheet

HINGE DEVICE FOR CASINGS

FIELD OF THE INVENTION

The present invention relates to a hinge device for casings and, more particularly, to an improved hinge device for casings of the type comprising of an upper cover and a body portion.

DISCUSSION OF BACKGROUND

Many hinge devices are used in casings, such as portable computers, of the type having an upper cover and a body portion, to discretionally retain the upper cover in a desired position relative to the body portion by friction. However, such hinge devices tend to malfunction after long-term usage. For example, one type of hinge device utilizes a spring around a pivotal axle, and by means of the friction between the tightly-contacted surface of an inner periphery of the spring and an outer periphery of the pivotal axle achieves the above-mentioned purpose. However, after long-term usage, the spring and the pivotal axle are unable to provide a sufficiently tight contact relationship therebetween due to abrasion.

Therefore, there has been a long and unfulfilled need for an improved hinge device to mitigate and/or obviate the aforementioned problems.

SUMMARY OF THE INVENTION

The present invention provides a hinge device for a casing having a body portion and an upper cover, including a substantially L-shaped mounting plate, two washers, a pivotal axle, a spring means, and a nut. The L-shaped mount plate has a vertical portion to which the washers are respectively mounted on both sides thereof and a horizontal portion adapted to be securely mounted to the body portion of the casing. The pivotal axle includes a mounting portion located at a first side of the vertical portion and adapted to be securely mounted to the upper cover of the casing, a flange portion abutting the washer located on the first side of the vertical portion, and an extension fittingly and pivotably received in a hole of the vertical portion. The spring means is mounted around the extension of the pivotal axle. The nut is mounted on a threaded end portion of the extension to bias the spring means between the nut and the washer located on the second side of the vertical portion.

Under such an arrangement, the pivotal axle is freely pivotable relative to the spring means. When a desired position of the upper cover relative to the body portion of the casing is reached, the spring means biased by the nut exerts a longitudinal force on the pivotal axle, such that the flange portion of the pivotal axle is tightly positioned against the washer located on the first side of the vertical portion, thereby retaining the pivotal axle in position.

Other advantages and novel features of the invention will become more apparent from the following detailed description when taken in conjunction with the accompanying drawings.

DESCRIPTION OF THE PREFERRED EMBODIMENTS

Figure 1:
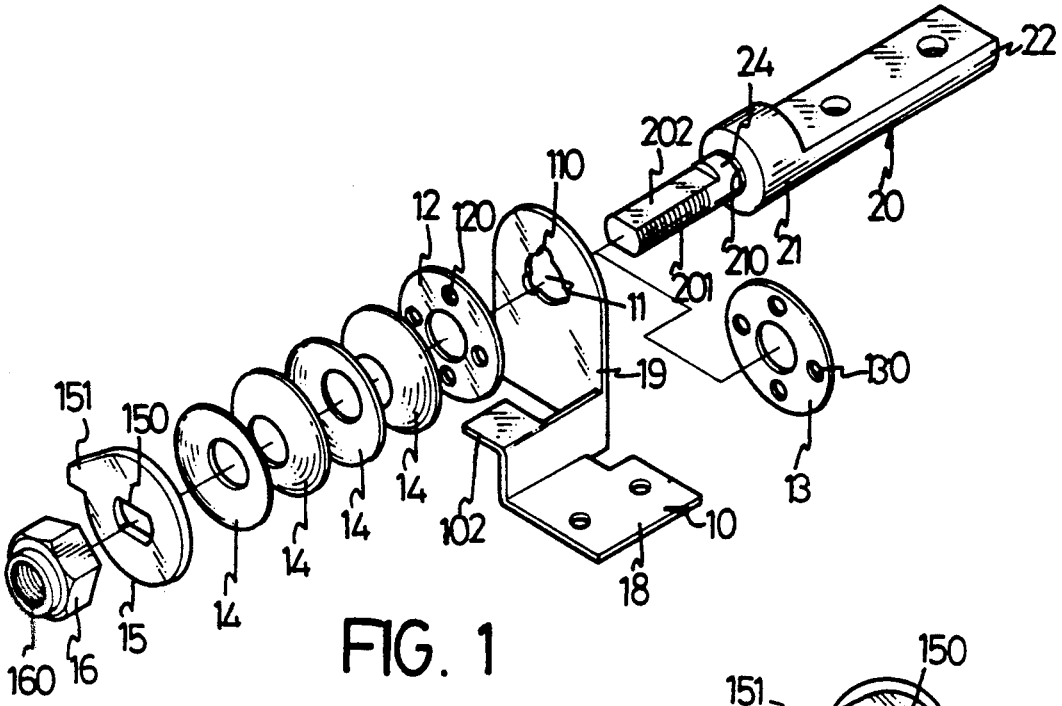
FIG. 1 is an exploded view of a hinge device in accordance with the present invention.
Figure 2:
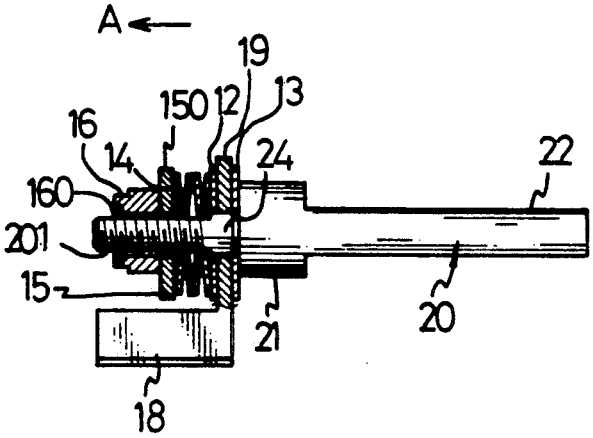
FIG. 2 is a partial cross-sectional view of the hinge device.

Referring to the drawings and initially to FIGS. 1 and 2, a hinge device in accordance with the present invention generally includes a substantially L-shaped mounting plate 10 which has a vertical portion 19 with a hole 11 and a horizontal portion 18 adapted to be securely mounted to a body portion of a casing (not shown), such as a portable computer or the like.

The hinge device further has a pivotal axle 20 passing through the hole 11. The pivotal axle 20 includes a mounting portion 22 adapted to be securely mounted to an upper cover (not shown) of the above-mentioned casing, a flange portion 21, and an extension 24 fittingly and pivotably received in the hole 11 of the vertical portion 19. The extension 24 has a threaded end portion 201. The hinge device further has two washers 13 and 12 respectively mounted on both sides of the vertical portion 19, a spring means consisting of four disc-like springs 14, a restraining member 15, and a nut 16. As clearly shown in FIG. 2,. the pivotal axle 20 passes through the hole 11 with the mounting portion 22 and the flange portion 21 thereof located on a first side of the vertical portion and with a part of the extension 24 thereof pivotally received in the hole 11. Furthermore, the threaded end portion 201 is on the other side of the vertical portion 19 of the mount plate 10. Directly attached to the other side of the vertical portion 19 of the mount plate is the other washer 12. Thereafter, the spring means is mounted around the extension 24 of the pivotal axle 20. Then the restraining member 15 and the nut 16 are assembled on the threaded end portion 201. The nut 16 is screwed inward to bias the spring means.

When a user intends to open the casing, the upper cover thereof is opened by means of pivotal movement of the pivotal axle 20 relative to the mount plate 10. During the pivotal movement, the pivotal axle 20 is freely pivotable relative to the spring 14. When a desired position of the upper cover relative to the body portion of the casing is reached, the user releases the upper cover and the upper cover is positioned. This is because the spring means which is biased by the nut 16 exerts a longitudinal force (as indicated by the arrow A in FIG. 2) on the pivotal axle 20 (since the vertical portion 19 is fixed), such that the flange portion 21 of the pivotal axle is tightly positioned against the washer 13 and such force is sufficient to retain the pivotal axle 20 in position. Additionally, oil grooves 110 extending outward form the hole 11 may be provided to provide a smooth pivotal movement. Oil holes 120 may be provided in the washers 12 and 13 to provide a smooth contact surface between the washers 12 and 13 and the vertical portion 19 of the mount plate 10. Furthermore, a gasket 160 can be provided in the nut 16 around the threaded end portion 201 to assist in retaining the pivotal axle 20 in position.

Figure 3:
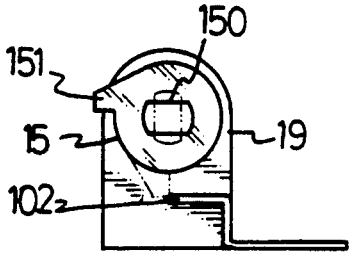
FIG. 3 is a schematic side view of the hinge device.

Referring now to FIG. 3, the restraining member 15 has a protrusion 151 projecting from an outer periphery thereof. When the upper cover of the casing is opened to a preset maximum angle relative to the body portion of the casing (see the phantom lines), the protrusion 151 contacts with and is stopped by a stop 102 of a plate 12 extending from the vertical portion 19 of the mount plate 10.

Referring to FIG. 1, an annular groove 210 may be formed in the extension 24 adjacent to the flange portion 21 to correct problems that may occur after manufacture. This is because the pivotal axle 20 is conventionally manufactured by a lathe, which results in a small protrusion adjacent to the flange portion 21 thereof since the cutter of the lathe lies on a plan having an angle relative to the axis of the pivotal axle 20, such that the pivotal axle cannot be completely drawn longitudinally to provide the positioning effect. The provision of the groove 210 assures that the pivotal axle can be completely drawn longitudinally to achieve the positioning effect. Furthermore, oil can be applied into the groove 210 to provide a smooth pivotal movement of the pivotal axle 20 relative to the vertical portion 19 of the mount plate 10.

In the embodiment of the present invention the threaded end portion 201 is cut to form two opposite planar surfaces 202, and the restraining member 15 has a corresponding hole 150. Nevertheless, it is appreciated that many other modifications can be made without departing from the principle of the invention.

Although the invention has been explained in relation to its preferred embodiment, it is to be understood that many other possible modifications and variations can be made without departing from the spirit and scope of the invention as hereinafter claimed.

I claim:

1. A hinge device for a casing having a body portion and an upper cover, comprising:

a substantially L-shaped mounting plate having a vertical portion with a hole and a horizontal portion adapted to be securely mounted to said body portion of said casing;

a pivotal axle comprising a mounting portion located on a first side of said vertical portion and adapted to be securely mounted to said upper cover of said casing, a flange portion also located on said first side of said vertical portion, and an extension with a portion thereof fittingly and pivotally received in said hole of said vertical portion of said mounting plate and having a threaded end portion;

a first washer mounted on said extension of said pivotal axle and attached to said first side of said vertical portion of said mounting, plate between said vertical portion and said flange portion;

a second washer mounted on said extension of said pivotal axle and attached to a second side of said vertical portion of said mounting plate;

spring means mounted around said extension of said pivotal axle; and a nut mounted on said threaded end portion of said extension to bias said spring means between said nut and said second washer;

whereby said pivotal axle is freely pivotable relative to said spring means, when a desired position of said upper cover relative to said body portion of said casing is reached, said spring means upon being biased by said nut exerting a longitudinal force on said pivotal axle, such that said flange portion of said pivotal axle is tightly positioned against said second washer, thereby retaining said pivotal axle in position.

2. The hinge device as claimed in claim 1, further comprising a restraining member provided between said spring means and said nut, said restraining member having a protrusion projecting from an outer periphery thereof, and a stop extending from said mounting plate, such that when said upper cover of said casing is opened to a preset maximum angle relative to said body portion of said casing, said protrusion contacts with and is stopped by said stop.

3. The hinge device as claimed in claim 1, wherein at least one oil groove is formed in said hole to provide a smooth pivotal movement.

4. The hinge device as claimed in claim 1, wherein at least one oil hole is provided in each said washer to provide a smooth contact surface between each said washer and said vertical portion of said mount plate.

5. The hinge device as claimed in claim 1, further comprising a gasket provided in said nut around said threaded end portion to provide an assist to retain said pivotal axle in position.

6. The hinge device as claimed in claim 1, wherein said extension has an annular groove adjacent to said flange portion.

* * * * *